United States Patent [19]

Flynn

[11] 4,222,404

[45] Sep. 16, 1980

[54] SYSTEM FOR OPENING AND CLOSING DOORS TO A VACUUM BODY

[75] Inventor: Thomas P. Flynn, Milwaukee, Wis.

[73] Assignee: Super Products Corporation, New Berlin, Wis.

[21] Appl. No.: 964,668

[22] Filed: Nov. 29, 1978

[51] Int. Cl.[3] ..... B08B 5/04

[52] U.S. Cl. ..... 137/205; 137/883; 137/414; 137/567

[58] Field of Search ..... 137/205, 567, 414, 883

[56] References Cited

U.S. PATENT DOCUMENTS

| | | | |
|---|---|---|---|
| 3,049,331 | 8/1962 | Quesinberry | 137/413 X |
| 3,378,025 | 4/1968 | Hilde | 137/205 |
| 3,885,932 | 5/1975 | Moore . | |
| 3,901,274 | 8/1975 | Taber | 137/567 |

*Primary Examiner*—Alan Cohan

[57] ABSTRACT

The present invention is concerned with apparatus for selectively opening and closing doors to vacuum bodies, for example the bodies of industrial vacuum loaders and cleaners and the vacuum bodies used in pneumatic sewer cleaners. The doors involved in the primary embodiment are those which cover the opening between the body and a filter bag house or a vacuum pump or the opening which may be provided for venting the body to outside air to prevent overfilling of the body. The apparatus of the present invention includes a sensor for providing a signal to a pneumatic cylinder. Pneumatic valves and switches are also provided for governing which openings are to be opened and which are to be closed for the desired operating mode. In the preferred embodiment, the cylinders are coupled to hinged doors for swinging same into and out of sealing contact with the openings. In an alternate embodiment of the present invention, the apparatus of the present invention serves as a back-up for a float system which is used to prevent overfilling when the vacuum body is filled to the desired level, and in the event the float does not operate to prevent overfilling, a sensor generates a signal to cause extension of the piston of a pneumatic cylinder to move a door to seal a vacuum outlet to the body and prevent overfilling of same.

4 Claims, 5 Drawing Figures

SYSTEM FOR OPENING AND CLOSING DOORS TO A VACUUM BODY

FIELD OF THE INVENTION

The present invention relates generally to the art of control systems for selectively opening and closing inlets or outlets to a vacuum body, and more specifically to a system for selectively opening and closing certain inlets or outlets of vacuum bodies used in industrial vacuum loaders and cleaners or in mobile, pneumatic sewer cleaners.

BACKGROUND OF THE INVENTION

Mobile, truck mounted industrial vacuum loaders and cleaners typically include a vacuum body and a vacuum pump coupled to an outlet of the body. One or more inlets are provided to the body and a hose is coupled to the inlets so that a high velocity stream of air may be drawn through the hose to permit loading of material into the body.

It is also common with such equipment to provide a bag house filter between the body and the vacuum pump for filtering the air before it reaches the pump and to prevent damage to the pump, a problem which is especially severe with the expensive positive displacement vacuum pumps being used in modern industrial vacuum loaders and cleaners.

One type of such machines also includes a by-pass feature which permits all or a portion of the filter bags to be bypassed if the machine is being used to load liquids. This necessitates at least two flow paths between the body and the pump, and in most cases two outlets from the body. In this type of modern equipment, the filter bag house includes two sets of in-line filter bags, the by-pass arrangement allowing air, and any entrained debris leaving a first one of the body outlets to be filtered in series through both sets of filters before reaching the pump. This operating mode is typically used when solids are being loaded into the body and where the greatest amount of dust is encountered. In another operating mode, air leaves a second body outlet and is filtered through only a portion of the filter bags before reaching the pump. This mode is used when liquids are being loaded into the body and where fine dust filtration is not necessary.

The changeover from solid to liquid operating modes for such equipment is typically done by manually opening and closing doors inside the body to prevent air from leaving the body other than through the desired exit port. Doors pivotally hinged adjacent the port openings are the most common arrangement, and the operator swings the doors into and out of position and latches the doors in the desired configuration. The changeover is time consuming and requires the machine operator to enter the collection body. It has been suggested that the desired changeover could be accomplished by doors which are moved from outside the body, for example from the top of the body. These suggestions do not overcome all the problems with present designs because the changeover is still time consuming and requires the operator to climb to the top of the body.

Another feature of modern industrial vacuum loading and cleaning equipment is a system for automatically closing a body exit port when liquids are being collected and the liquid reaches a predetermined level. In the type of machine referred to above, the overfilling system includes a float mounted in the body and a connecting element joining the float to a door. When the liquid in the body reaches a certain level, the float is raised through its own buoyancy and, as filling continues, the connecting element pushes the door toward its closed position. Due to the vacuum air flow being drawn through that exit port, when the door approaches sealing engagement, it will be tightly closed by the vacuum and will remain closed until the vacuum is turned off.

In practice it has been noted that the float mechanism, under some conditions, can foul. If the machine operator is not careful, overfilling can then result leading to costly damage to the filter bags and, even more importantly, to the vacuum pump. The solution to this problem is complicated by the interrelationship of the float overfill protection system with the normal liquid-solid changeover procedures.

For purposes of reference, a typical industrial vacuum loader and cleaner with which the present invention is concerned is described in detail in commonly assigned U.S. Pat. No. 3,885,932 issued May 27, 1975, to Lionel G. Moore, Jr. and Thomas P. Flynn and entitled "Dust Filtration System."

Another variety of cleaning machine with which apparatus of the present invention may be used is the pneumatic sewer cleaning equipment. In this type of equipment, a vacuum collection body is also provided, as is a vacuum pump (such as a positive displacement vacuum pump). One or more inlets are provided to the body and an outlet opening of the body is coupled to the vacuum pump so that a high velocity air stream may be drawn through the body. Such machines also typically include a water tank and a hose for injecting water under pressure from the tank into a sewer lateral for flushing debris into a catch basin. Another hose is coupled to the body inlet and lowered into the sewer catch basin. The high velocity air stream drawn though the latter hose pneumatically conveys water and entrained debris into the body. As was the case with industrial vacuum loaders and cleaners, overfilling protection is required for this type of machine. One method in use today comprises providing a liquid level sensor in the body, the sensor being designed for emitting a signal when the liquid level in the body reaches a predetermined level. The sensor is coupled to a vent door to the body located above the predetermined level. The door normally closes a vent opening into the body, but upon receiving a signal, the door is opened to allow air to enter the body. The size of the vent hole is selected so that the vacuum in the body will be reduced to thereby reduce the air velocity in the inlet hose and thus prohibit continued loading. Other systems are known for preventing overfilling, such as the float-door closing system previously discussed for the liquid operating mode of the industrial vacuum loading and cleaning machine.

For purposes of illustration, one type of sewer cleaning machine with which the present invention is concerned is disclosed in a commonly assigned, copending application Ser. No. 828,631, filed Aug. 29, 1977 for "Sewer and Catch Basin Cleaner."

The overfill protection system used with these types of machines also suffer from various drawbacks. For example, the vent door may foul from weathering or from deterioration caused by some materials, and in the event of such failure, the vacuum pump can be damaged, leading to expensive repair or replacement.

A system for positively opening and closing ports to a vacuum body which overcomes the aforementioned problems would be a significant advance in this technology.

OBJECTS OF THE INVENTION

It is a primary object of the present invention to provide a novel system for moving a closure toward and away from an opening.

Another object of the present invention is to provide a system for positively and selectively opening and closing an opening, such as an opening to a vacuum body.

Still another object of the present invention is to provide a system for automatically opening one vacuum body outlet and simultaneously closing another vacuum body outlet.

Yet another object of the present invention is to provide a closure system useful as a back-up system for positively moving a door into sealing engagement with an opening in the event of primary closure system failure.

Another object of the present invention is to provide a novel link assembly coupled to both back-up and primary closure systems in such a manner that the operation of the alternate systems do not interfere with one another.

How these and other objects of the invention are accomplished will be described in the following specification taken in conjunction with the FIGS. Generally, however, the objects are accomplished in the invention's preferred embodiment by providing a closure member, such as a door hingedly mounted adjacent an opening for selective movement into and out of engagement therewith. A cylinder, such as a pneumatic cylinder, is provided which includes a piston, the free end of the piston being coupled to the door through a link member. In the embodiment where the closure system of the present invention is to be used as a back-up system for a primary closure system, a special link assembly is used. The preferred link assembly includes an elongate slot through which pin means slide during normal operation. In the event the primary closure system fails, the cylinder acts on the link assembly to close the door. The present invention also includes pneumatic piston control means and a valve system for permitting independent use of the back-up system if desired. In the preferred embodiment, the closure system is coupled to two doors and the control system is adapted for selectively opening and closing two exit ports from a vacuum body.

DESCRIPTION OF THE PREFERRED EMBODIMENT

Figure 2:
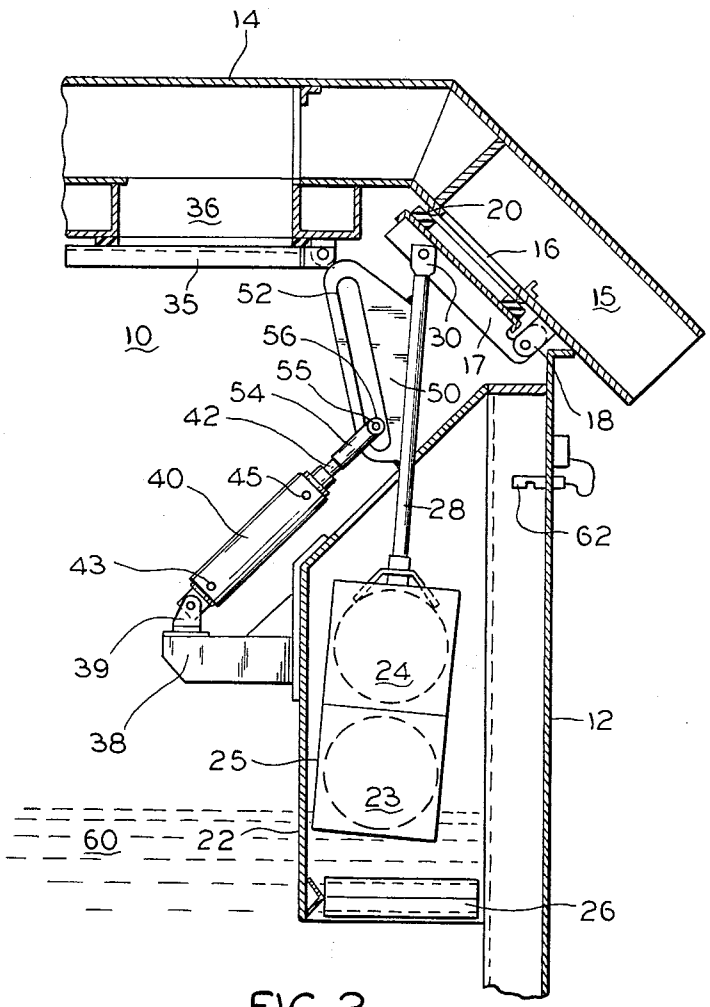
FIG. 2 is a view similar to FIG. 1 but showing the door closed by the float mechanism.
Figure 1:
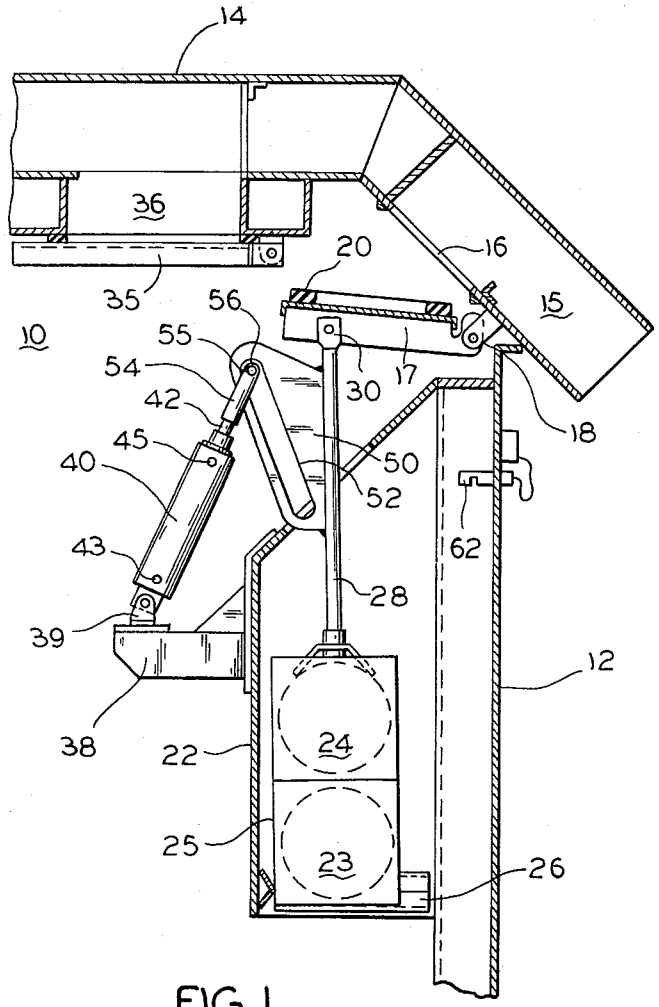
FIG. 1 is a partial cross-section view showing one preferred form of the present invention adapted for use as a back-up closure system for a float actuated primary closure system, the door for the exit port being in an open position.
Figure 3:
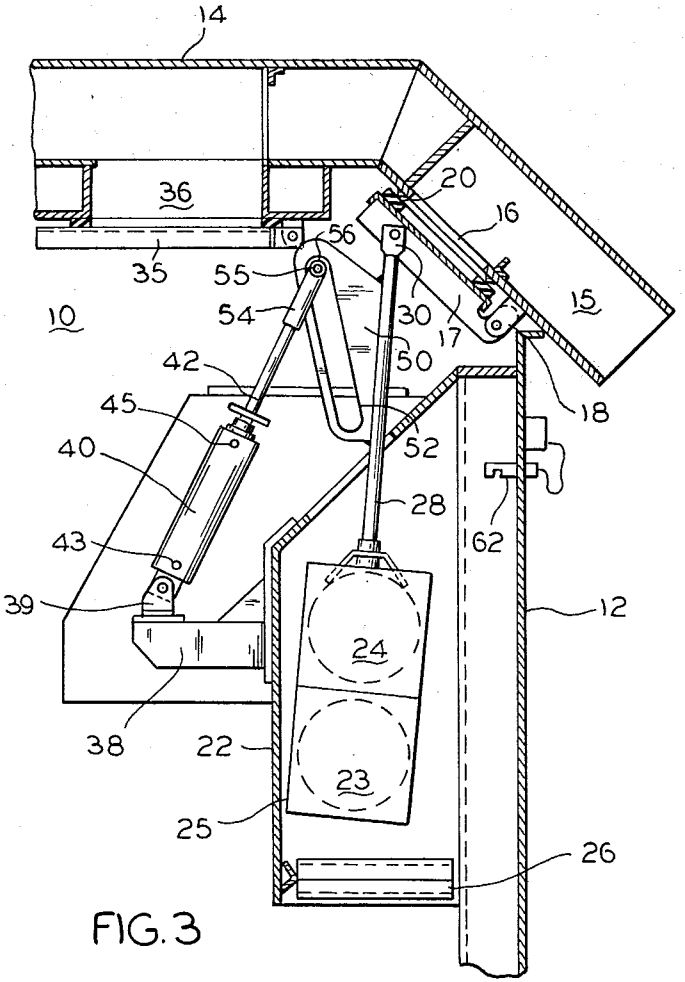
FIG. 3 is a view similar to FIGS. 1 and 2 but showing the door to be closed by the operation of the closure system of the present invention.

Referring first to FIGS. 1–3, the preferred embodiment of the present invention will be illustrated in connection with a float closure mechanism useful in the above-described type of industrial vacuum loader and cleaner. A detailed description of the components of such machines will not be provided here, it being sufficient to show only a portion thereof. The details of such machines can be obtained by reference to the aforementioned U.S. Pat. No. 3,885,932.

In FIG. 1, the upper front portion of a vacuum body 10 is shown. Body 10 includes a front wall 12 and a top 14. It should be appreciated at this point that the vacuum body 10 includes one or more suitable inlet openings, usually at its rear, and that a vacuum pump and filter bag house are typically provided in front of body 10, or to the right of front wall 12 as shown in FIGS. 1–3.

An exit conduit 15 is located adjacent the top of body 10, the free end of which is coupled to the filter bag house (not shown) so that air flowing through the conduit passes through at least a portion of the filter bags before reaching the vacuum pump. Conduit 15 communicates with the interior of body 10 through an opening 16 and a door 17 is provided on body 10 for closing opening 16 at appropriate times to stop the flow of air from body 10 through exit conduit 15. Door 17 is mounted on hinge 18 for swinging movement into and out of engagement with opening 16 and preferably includes a sealing gasket 20 around its periphery to insure a tight seal.

Mounted below opening 16 on the front wall 12 of body 10 is a float housing 22 which is generally square in horizontal cross-section. Housing 22 has an open bottom and an open top and is preferably constructed of sheet metal. Two cylindrical floats 23 and 24 mounted one on top of the other, are covered by a casing 25 within housing 22, and as can be seen from FIG. 1, the floats normally rest on a seat 26 at the bottom of housing 22.

An elongate rod 28 is mounted between the top of casing 25 and the bottom of door 17 at a location which is remote from hinge 18, the preferred coupling being a clevis 30. In normal operation, when water enters body 10 it will gradually fill the body until the liquid level reaches housing 22. As the water level continues to rise, the buoyancy of the floats will cause them to rise and cause door 17 to be gradually closed. It can also be mentioned here that the float housing 22 is not an essential part of the system but it is desirable because it protects the floats from direct contact with the debris being loaded into body 10.

Another component of body 10 is also shown in FIGS. 1–4, i.e. door 35. Door 35 in these FIGS. covers an opening 36 which communicates with another air flow exit conduit which itself is not visible in these cross sections (as is more fully appreciated by reference to the aforementioned U.S. Pat. No. 3,885,932). For present purposes it will be sufficient to state that when dry materials are being collected in body 10, door 17 is closed and door 35 is opened so that air is drawn through the latter exit conduit into the bag house before reaching the vacuum pump.

Proceeding next to the description of the back-up closure system of the present invention, a horizontal support ledge 38 is mounted to the rear vertical face of float housing 22, and a bracket 39 is mounted thereto. Pivotally coupled to the bracket 39 is the butt end of a cylinder 40 which includes an extensible piston rod 42. In the illustrated embodiment, cylinder 40 is pneumatic and accordingly air inlet and outlet ports 43 and 45 are shown. The air supply and exhaust hoses are, however, not shown for purposes of simplifying the FIGS. It should be appreciated that the piston 42 is extended when air enters cylinder 40 through port 43 (air being exhausted through port 45) and that the piston 42 is retracted when the air flow is reversed. A hydraulic cylinder could be used in place of the pneumatic cylinder. Cylinder 40 is oriented in a generally vertical direction with piston 42 directed toward opening 16.

A plate link member 50 is welded or otherwise securely fastened to coupling rod 28, member 50 being generally coplanar with piston 42 and oriented toward the rear of body 10. Plate member 50 is narrow at the bottom and wider at its top and includes an elongate slot 52 which extends from near its bottom toward the top.

The final element of the back-up closure system is a fork shaped slide element 54 which is coupled to the free end of piston 42 and has parallel sides which extend in front and in back of element 50. The ends of slide element 54 are joined by a pin 55 which supports a roller 56 within slot 52. The arrangement of the pin, roller and slot is such that the roller may move freely within slot 52 during some of the operating procedures now to be described.

FIG. 1 shows a first operating position of the closure system wherein the floats 23 and 24 are in their lowermost position, door 17 is open and roller 56 is located at the top of slot 52.

FIG. 2 shows a second operating position in which the floats 23 and 24 have been raised by water 60 which has partially filled body 10. During the elevation, door 17 has been closed to seal body 10 and prevent air flow through exit conduit 15. The cylinder has not been operated in this embodiment and thus the elevation of plate 50 has caused the roller 56 to slide down slot 52 toward its bottom. It can be noted here that the slight upward and rearward angulation of slot 52 is designed to permit this roller movement with no change in the distance between pin 55 and bracket 39. It can also be noted that the piston has reached a more nearly horizontal orientation during the movement of plate 50 from the positions shown respectively in FIGS. 1 and 2.

In FIG. 3, a third operating position is shown. In this FIG. the piston 42 has been extended causing roller 56 to urge against the upper portion of slot 52 thereby raising the float members and moving door 17 to its closed position. This position can result from either of two conditions. First, if the operator desires to close door 17, for example to switch from the wet cleaning mode to the dry cleaning mode, the changeover can be accomplished by a control switch, not shown, which would cause air to enter port 43 to extend piston 42. Alternately, in the event that the float door closing system fails, piston 42 can be extended automatically in response to a signal generated by a sensor 62 mounted in body 10 at the highest permissable water level. Sensor 62 generates a signal to the pneumatic control system (one of which will be described later) causing air to enter port 43 and to exit from port 44. One suitable type of sensor is an ultrasonic sensor, but other types of sensors including float valves could also be used. The details of the sensor system are not provided here, because in and of itself it forms no part of the present invention. It should be apparent from FIGS. 1–3 that door 17 may be returned to its open position shown in FIG. 1 by lowering the water level in body 10 or by either sensor or manual control of the pneumatic system to cause piston 42 to be retracted.

Figure 4:
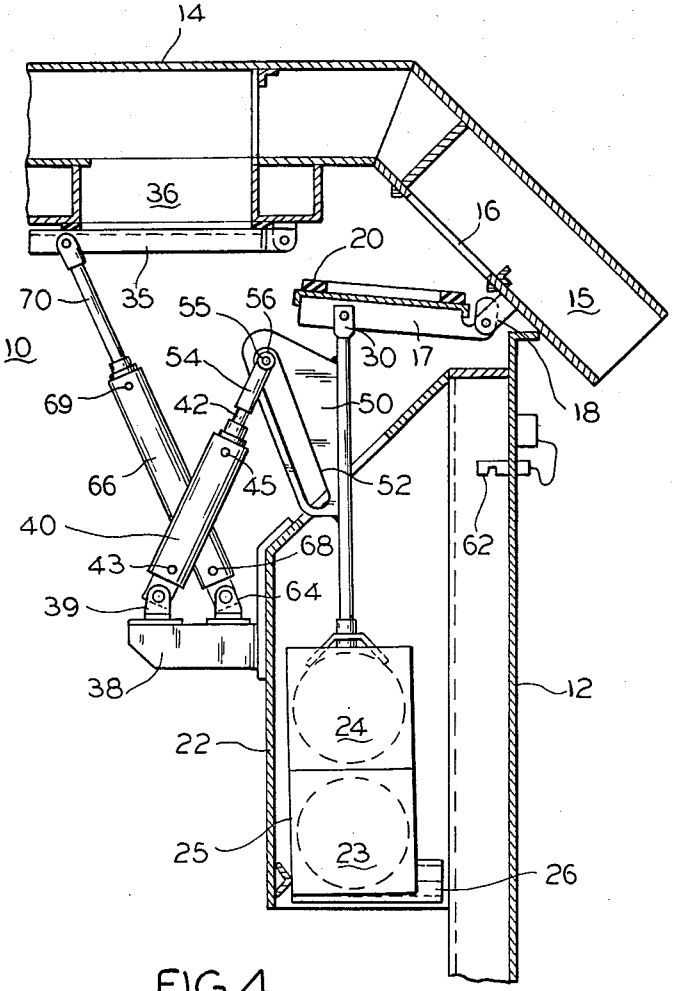
FIG. 4 is a view similar to FIGS. 1–3 but showing two cylinders coupled to two doors.

Referring next to FIG. 4, an alternate embodiment of the present invention is shown to include another bracket 64 mounted to ledge 38, bracket 64 in turn supporting a second cylinder 66 including pneumatic inlet and outlet ports 68 and 69. Cylinder 66 is oriented generally toward door 35 and includes a piston 70.

The operation of the alternate closure system embodiment of FIG. 4 is similar to the FIG. 1–FIG. 3 embodiment except cylinders 40 and 66 are used respectively for opening and closing doors 17 and 35 at the discretion of the machine operator. If dry materials are being collected in body 10, door 35 will be opened and door 17 will be closed, while the order would be reversed if liquids are being collected. Of course, the FIG. 4 embodiment is shown in conjunction with the float closure system for door 17, but if such a float system is not used, the pneumatic cylinder system can perform all the desired closure functions.

Figure 5:
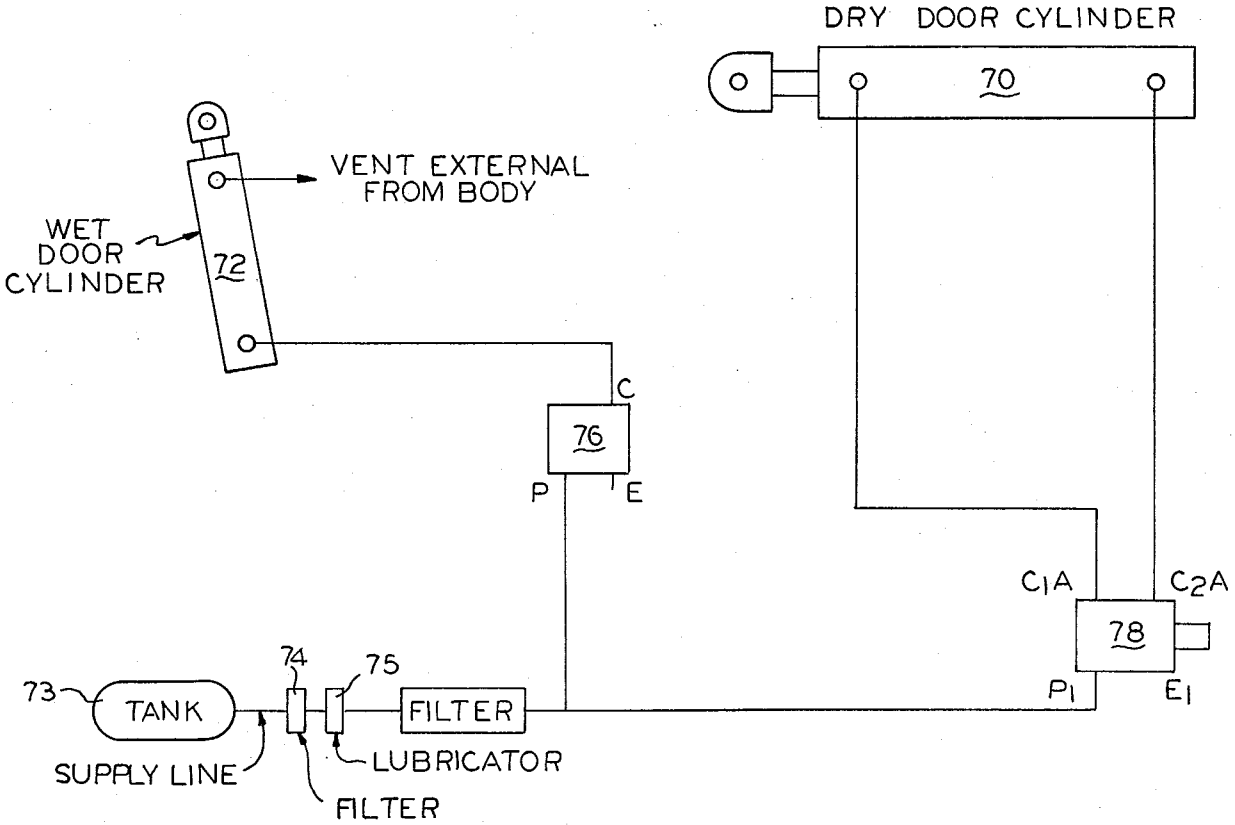
FIG. 5 is a schematic diagram of the preferred form of pneumatic circuit useful for the embodiment shown in FIG. 4.

Referring next to FIG. 5, a pneumatic circuit is illustrated for the FIG. 4 embodiment of the present invention, i.e. one in which the two cylinders are used in an industrial loader and cleaner of the type described above. A first cylinder 70 in this embodiment is provided for closing the exit port door (not shown) in the event that the water level in the cleaner body reaches the desired level. A second cylinder 72 is provided for opening and closing the door covering the exit port which is used when dry materials are collected.

Also shown in FIG. 5 are in air tank 73 and the filter 74 and lubricator 75 components typically found in pneumatic circuits and two solenoid valves 76 and 78 for controlling the direction of pneumatic flow. The various pneumatic lines are also shown in the circuit but are not identified with reference numerals.

FIG. 5 also shows the respective valve positions for wet and dry modes of operation. Valve 76 in the dry mode is switched to the activated position causing air to enter port P, exit port C and extend the piston of cylinder 72 to close the wet door. At the same time, valve 78 is moved to its "dry" position allowing air flow from ports $P_1$ to $C_1A$ through cylinder 70 and then to $C_2A$ to $E_1$ to cause the piston of cylinder 70 to be retracted, thus opening the dry door.

If the operator desires to switch the operating modes of the machine, the two valves are reversed whereby the inlet port of valve 76 is closed and fluid is allowed to flow from ports C to E of the valve to permit the opening of the wet door. At the same time, the inlet air will flow from port $P_1$ to port $C_2A$ of valve 78 to permit charging of cylinder 70 and extension of its piston. Air is exhausted from cylinder 70 through the route $C_1A$ to $E_1$.

Both doors, can, of course, be closed by locating the valves respectively in the activated and wet positions.

While control of the pneumatic circuit is manual in most instances, i.e. when the operator decides to switch from one operating mode to another, the valves 76 and 78 can be automatically switched to the desired position in response to one or more sensors which are adapted for signaling a dangerously high water level in the body. As indicated previously, the sensors in and of themselves, are well known and accordingly they will not be described in detail.

While the present invention has been described in connection with industrial vacuum loaders and cleaners, the principles are readily applicable for use with pneumatic sewer cleaning equipment of the type previously described. For example, the embodiment of FIGS. 1–3 can be used to back-up or manually close an air exit to prevent overfilling of a vacuum body, or a cylinder may be used to automatically open a vent to the body in the event that the liquid debris level exceeds a certain height. Moreover, the principles of the invention can be variously embodied for other systems wherein one or more doors need to be opened or closed. Accordingly, the principles of the invention are not to be limited by the foregoing preferred embodiments but are to be limited solely by the claims which follow.

I claim:

1. An apparatus for selectively opening and closing two openings of a housing comprising:

door means mounted adjacent each of said openings for being selectively moved into and out of sealing engagement with said openings;

a pair of cylinder means mounted to said housing and each including an extensible piston means arranged whereby extension of said piston means causes said doors to be moved into sealing engagement with said openings;

fluid supply and exhaust means coupled to said cylinder means for causing selective extension and retraction of said piston means;

valve means and switch means coupled to said fluid means for selectively causing extension or retraction of said piston means at the discretion of the operator of the apparatus;

sensor means mounted within said housing and adapted to emit a signal in response to a filling condition of said housing, said sensor means being coupled to said valve and switch means to automatically cause extension of a first one of said piston means to cause a first one of said doors to be moved into sealing engagement with its respective opening when said filling condition has been reached; and float closure means coupled to said first door means for positively closing its respective opening when the level of liquids contained within said housing reaches a pre-selected height, said first piston means being coupled to said float closure means and the second one of said piston means being coupled to the second one of said door means.

2. The invention set forth in claim 1 wherein said housing is a vacuum housing including inlet ports and two outlet ports selectively and independently communicating with a vacuum pump means and wherein said apparatus is adapted for selectively opening and closing the outlet ports.

3. The invention set forth in claim 1 wherein said float closure means includes a buoyant float and an elongate rod means coupling said float to said first door means.

4. The invention set forth in claim 3 wherein a plate means is mounted to said rod means intermediate said float and said first door means, said plate means including an elongate slot extending generally parallel to said rod means, the free end of said first piston means being slidably received within said slot and said piston means and plate means being arranged whereby said free end of said piston means moves independently within said slot during movement of said plate means towards said opening normal operation of said float closure means, and wherein said first piston means urges said plate means towards said opening upon extension of said piston means for selective non-float activated sealing of said opening.

* * * * *